US009578428B2

(12) United States Patent
Ozden

(10) Patent No.: US 9,578,428 B2
(45) Date of Patent: Feb. 21, 2017

(54) HEARING AID SYSTEM AND A MICROPHONE DEVICE

(71) Applicant: GN ReSound A/S, Ballerup (DK)

(72) Inventor: Sinasi Ozden, Soborg (DK)

(73) Assignee: GN HEARING A/S, Ballerup (DK)

( * ) Notice: Subject to any disclaimer, the term of this patent is extended or adjusted under 35 U.S.C. 154(b) by 38 days.

(21) Appl. No.: 13/725,714

(22) Filed: Dec. 21, 2012

(65) Prior Publication Data

US 2013/0163798 A1 Jun. 27, 2013

(30) Foreign Application Priority Data

Dec. 23, 2011 (DK) ..... PA 2011 01004

(51) Int. Cl.
*H04R 25/00* (2006.01)

(52) U.S. Cl.
CPC ..... *H04R 25/554* (2013.01); *H04R 2225/51* (2013.01); *H04R 2225/61* (2013.01)

(58) Field of Classification Search
CPC ..... H04B 1/385; H01Q 1/273; H04R 2420/07; H04R 25/554; H04R 2225/51
USPC ..... 381/315, 331, 364; 455/41.2–41.3, 100
See application file for complete search history.

(56) References Cited

U.S. PATENT DOCUMENTS 3,134,074 A * 5/1964 Litke ..... H01Q 1/273 343/718
5,905,473 A * 5/1999 Taenzer ..... H01Q 3/2605 343/834
6,680,707 B2 * 1/2004 Allen et al. ..... 343/718
6,810,237 B1 * 10/2004 McEowen ..... H01Q 1/085 455/575.6
7,023,389 B2 * 4/2006 Demicco et al. ..... 343/702
7,551,894 B2 * 6/2009 Gerber ..... H04R 25/554 381/122

(Continued)

FOREIGN PATENT DOCUMENTS

CN 101895510 A 11/2010
WO WO 2011/006496 A1 1/2011

OTHER PUBLICATIONS

First Office Action dated Jun. 15, 2012, for DK Patent Application No. PA 2011 01004.

(Continued)

*Primary Examiner* — Curtis Kuntz
*Assistant Examiner* — Ryan Robinson
(74) *Attorney, Agent, or Firm* — Vista IP Law Group, LLP

(57) ABSTRACT

A hearing aid system comprising a microphone device for wireless communication with a hearing aid to be worn at or in proximity to a first user, the microphone device configured to be worn at or in proximity to a second user, the microphone device includes: a housing; a microphone for conversion of an acoustic sound signal into an electrical signal; a transceiver for wireless radio frequency communication; a first antenna connectable to the transceiver; and a second antenna connectable to the transceiver; wherein the first antenna is accommodated within the housing; and wherein the second antenna is external to the housing such that the second antenna can be carried at or in proximity to the second user at a distance from the housing; and wherein the microphone device further comprises a distributor for distributing power to the first antenna, to the second antenna, or to both.

32 Claims, 6 Drawing Sheets

(56) References Cited

U.S. PATENT DOCUMENTS

| | | | | |
|---|---|---|---|---|
| 8,150,057 | B2 * | 4/2012 | Dunn | H04L 1/0045 381/312 |
| 2005/0075149 | A1 | 4/2005 | Gerber et al. | |
| 2007/0282393 | A1 | 12/2007 | Marquis | |
| 2010/0150387 | A1 * | 6/2010 | Dijkstra | H04R 25/43 381/315 |
| 2010/0304704 | A1 * | 12/2010 | Najafi | 455/404.1 |
| 2012/0075151 | A1 * | 3/2012 | Jenwatanavet | H01Q 1/273 343/718 |
| 2012/0231737 | A1 * | 9/2012 | Ponce De Leon | H04B 7/0689 455/41.2 |

OTHER PUBLICATIONS

Second Office Action dated Jan. 21, 2013, for DK Patent Application No. PA 2011 01004.

Notification of First Office Action and Search Report dated Mar. 27, 2015 for corresponding Chinese Patent Application No. 201210567319.3, 28 pages.

* cited by examiner

HEARING AID SYSTEM AND A MICROPHONE DEVICE

PRIORITY DATA

This application claims priority to and the benefit of Danish Patent Application No. PA 2011 01004, filed on Dec. 23, 2011, pending, the entire disclosure of which is expressly incorporated by reference herein.

FIELD

The present disclosure relates to hearing aid systems with a hearing aid and a microphone device and to microphone devices for communication with hearing aids.

BACKGROUND

A hearing aid compensates for the hearing loss of a hearing impaired. The hearing aid has a microphone that converts an acoustic sound signal from a sound source into an electric signal. The electric signal is processed for compensation of the hearing loss of the hearing impaired. The processed electric signal is converted into a processed acoustic signal by a receiver.

The signal to noise ratio in hearing aids can be improved by using microphone devices and hearing aid systems with a hearing aid and a microphone device where the microphone device communicates with the hearing aid. The microphone device is placed in proximity to the sound source and a microphone in the microphone device converts an acoustic sound signal from the sound source into an electric signal. The electric signal is communicated to the hearing aid from the microphone device. The proximity of the microphone device to the sound source allows for an improved signal to noise ratio.

An example of a sound source is a family member to the hearing impaired such as a child or a spouse. In this example the microphone device is placed on the family member.

However, during use in situations where the hearing impaired moves relative to the sound source the hearing aid can lose signal contact with the microphone device. This can be because of obstacles or that the person wearing the microphone device has lost the microphone device or turned in a direction relative to the hearing impaired. The signal to noise ratio thereby greatly decreases.

In some cases, a wired connection may be provided between the hearing aid and the microphone device. However, a wired connection does not allow for mobility of the user of the hearing aid relative to the microphone device.

Also, in some cases, two or more antennas may be provided in the hearing aid and/or in the microphone device for wireless communication between the microphone device and the hearing aid. However, this provides for devices that are difficult to adapt to changing situations and environments.

SUMMARY

It is an object to overcome at least some of the disadvantages as mentioned above, and it is a further object to provide a hearing aid system and a microphone device specifically for being operated in close proximity to a user.

Disclosed is a microphone device to be worn at or in proximity to a second user and for wireless communication with a hearing aid to be worn at or in proximity to a first user. The microphone device comprises a housing, a microphone for conversion of an acoustic sound signal into an electric signal, a transceiver for wireless radio frequency communication, a first antenna connectable to the transceiver, and a second antenna connectable to the transceiver, wherein the first antenna is accommodated within the housing, and wherein the second antenna is external to the housing such that the second antenna can be carried at or in proximity to the second user at a distance from the housing.

Further disclosed is a hearing aid system, the hearing aid system comprising a hearing aid to be worn at or in proximity to a first user and a microphone device to be worn at or in proximity to a second user wherein the hearing aid and microphone device are configured for wireless communication. The microphone device comprises a housing, a microphone for conversion of an acoustic sound signal into an electric signal, a transceiver for wireless radio frequency communication, a first antenna connectable to the transceiver, and a second antenna connectable to the transceiver, wherein the first antenna is accommodated within the housing, and wherein the second antenna is external to the housing such that the second antenna can be carried at or in proximity to the second user at a distance from the housing.

Even further disclosed is a method for transmitting wireless communication to a hearing device from a microphone device configured to operate in different modes of operation. The microphone device comprises a housing, a microphone, a transceiver for wireless radio frequency communication, a first antenna connectable to the transceiver and accommodated in the housing, and a second antenna connectable to the transceiver and external to the housing, the method comprising converting an acoustic sound signal to the microphone into an electric signal; transmitting a first radio signal representative of the acoustic sound signal via the first antenna in a first mode of operation; and transmitting a second radio signal representative of the acoustic sound signal via the second antenna in a second mode of operation.

The method may comprise selecting the first mode of operation when the second antenna is not connected to the microphone device. Transmitting a first radio signal in the first mode of operation may comprise transmitting at least 90% of the transmission power to the first antenna.

The method may comprise selecting the second mode of operation when the second antenna is connected to the microphone device. Transmitting a second radio signal in the second mode of operation may comprise transmitting at least 30% of the transmission power to the second antenna.

A hearing aid system is provided which has a hearing aid to be worn at or in close proximity to a first user and a microphone device configured to be worn at or in close proximity to a second user.

A part is at or in close proximity to a user when the part is attached or accommodated to a part of the body of the user or a piece of clothing or in a pocket or in another way close at hand such as lying at a table adjacent to the user.

The hearing aid and microphone device are configured for wireless communication.

The microphone device is provided with a housing and a microphone for conversion of an acoustic sound signal into an electric signal. The signal to noise ratio can be reduced because the microphone is proximate the second user and picks up sounds from the second user.

The microphone device comprises or is provided with a transceiver for wireless radio frequency communication to and/or from other devices, such as the hearing aid of the hearing aid system. The transceiver may be configured to operate as a transmitter and/or a receiver. The transceiver is configured to send first and/or second radio signals representative of the acoustic sound signals received in the microphone. The transceiver is able to transmit or send radio signal(s) with a transmission power. The transmission power may be split between a first antenna and a second antenna.

The microphone device further comprises or is provided with a first antenna connected or connectable to the transceiver, and a second antenna connected or connectable to the transceiver. Thus, the microphone device may be configured to send the electric audio signal or modulations thereof via the first antenna (first radio signal) and/or the second antenna (second radio signal). The microphone device may be configured to operate in different modes, e.g. dependent on a control signal from a controller and/or a user interface. For example, the microphone device may be configured to operate in a first mode, where the electric audio signal is only sent via the first antenna as a first radio signal. In combination or alternatively, the microphone device may be configured to operate in a second mode, where the electric audio signal is only sent via the second antenna as a second radio signal. Further modes may be employed. For example, the microphone device may be configured to operate in a mixed mode, where the electric audio signal is via both the first antenna (first radio signal) and the second antenna (second radio signal).

A part is connectable to another part when the parts can be attached or coupled or in another way interconnected for establishing a communication between the parts and also be detached or decoupled or in another way disconnected from each other for disrupting or disable a communication between the parts.

The first antenna is accommodated within the housing, and the second antenna is external to the housing such that the second antenna can be carried at or in proximity to a second user at a distance from the housing.

A housing can accommodate a part when there is room for the part or the part can in other ways fit within the interior of the housing and a part is external to the housing when it is not accommodated within the housing. When a part is at a distance of another part when the distance between the parts is not zero or that the parts in another way are not in abutment with each other.

This allows for flexibility with respect to the placement of the second antenna at or in proximity to the second user at a distance from the housing. For example, the second antenna may be placed in a pocket of a clothing of the second user if the user is in a situation where the user feels more comfortable with less visible electronic devices.

The microphone device may be provided with a fiber. The second antenna may be connectable to the transceiver, via the fiber. The fiber allows for increased flexibility of the placement of the second antenna on the user.

The fiber and the housing may be configured for interconnection. The fiber may be provided with a fiber connector, e.g. at a first end of the fiber, and the housing may be provided with a housing connector for interconnection of the fiber and the housing. Hereby, a connection between the fiber and the housing can be provided such that the second antenna cannot be removed by accident. By removing the fiber from the housing, the second antenna is detached from the transceiver. This allows for a more practical microphone device with no external components which can feel annoying to the user when the user is in situations where there is no need for the flexibility of a second antenna.

A part is interconnected with another part when the two parts are directly connected or fastened to each other, i.e. in abutting contact with each other; or when each of the two parts are both directly connected to the same third mechanical part; or when each of the two parts are both directly connected to a plurality of other interconnected mechanical parts, one of which is directly connected to one of the two parts and another of which is directly connected to the other of the two parts.

The second antenna can be attached to, embedded into or form a part of the fiber. Hereby, the second antenna and the fiber can be as one piece such that when the fiber is not connected to the housing and the second antenna is thereby detached from the transceiver, the fiber with the second antenna can be stored together.

The microphone device may comprise at least one connector for attachment of the microphone device at or in proximity to the second user. For example, the fiber can comprise a connector, such as a pin or clip, for attachment to a user during use. Further, the housing can comprise a connector, such as a pin or clip, for attachment to a user during use. This provides for flexible position of the fiber with the second antenna and the microphone device on the user with respect to each other. For example, the microphone device can be fastened to or clipped on to a collar of a clothing of the user such that the microphone of the microphone device is in proximity to the mount of the user thereby reducing the signal to noise ratio of the audio signal. However, if the signal to noise ratio of the wireless signal communicated to the hearing aid worn by the first user is thereby reduced, the fiber with the second antenna can be connected to the microphone device and/or attached to the second user at another point than where the housing is attached.

The fiber may be a neck fiber, wherein the neck fiber and the housing are configured for mutual interconnection. The user may place the neck fiber around the neck, e.g. forming a loop, whereby the neck fiber supports the microphone device at a position at or in proximity to a user body during use. Hereby, the neck fiber makes the microphone device less likely to fall of the second user and the second antenna accommodated at the fiber reduces the variance of the signal to noise ratio. This allows for a flexible movement of the user. For example, the second user can attach the neck strap and do outdoor activities together with the hearing aid user without losing the microphone device or without losing signal contact with the hearing aid.

The fiber can be configured for accommodation of the second antenna in the far field of the first antenna. Hereby, the second antenna experiences an environment which is more free space in nature than the first antenna experiences because the first antenna is accommodated within the housing of the microphone device.

The fiber can be a wire, a cable, a string or a lanyard. A wire or a cable is typically of a relative rigid material allowing the user to shape the wire into a desired shape whereas a string is typically of relative flexible material adapting to a surface it abuts. A lanyard is typically placed around the neck of a user.

The microphone device may comprise a distributor for distributing transmission power, e.g. to the first and/or second antenna. The distributor may comprise or be embodied as a switch. The microphone device may comprise a controller connected to the distributor for controlling the distributor. The controller may comprise a user interface configured to control the distributor. The controller may control the distributor based on a detection of whether or not the second antenna is connected to the microphone device. If the fiber is interconnected with the housing of the microphone device, the distributor allows for a distribution of the transmission power from the transmitter to the first antenna and the second antenna, such that the electric audio signal or a representation thereof, at least in a mixed mode of operation, is transmitted via both the first antenna and the second antenna, i.e. the microphone device transmits both a first radio signal from the first antenna and a second radio signal from the second antenna. A transmission power is thereby emitted from both antennas which allows for increased mobility of the user of the microphone device relative to the user of the hearing aid while simultaneously allowing for outdoor activities. A first radio signal with a first power is emitted from the first antenna and/or a second radio signal with a second power is emitted from the second antenna.

The microphone device may be configured to operate in a first mode when the second antenna is not connected to the microphone device, and the may distributor in the first mode of operation distribute at least 90% of the transmission power to the first antenna.

The microphone device may be configured to operate in a second mode when the second antenna is connected to the microphone device, and the distributor may in the second mode of operation distribute at least 30% of the transmission power to the second antenna.

Further, a microphone device to be used at or in close proximity to a user body is provided. The microphone device is configured for wireless communication with a hearing aid. Thus, the microphone device is configured to send and/or receive wireless communication to/from a hearing aid.

The microphone device is provided with a housing and a microphone for conversion of an acoustic sound signal into an electric signal. Since the microphone device is carried by the second user, the microphone is able to pick up sounds from the second user.

The microphone device is further provided with a transceiver for wireless radio frequency communication, a first antenna connectable to the transceiver and a second antenna connectable to the transceiver. The first antenna is accommodated within the housing, and the second antenna is external to the housing. In this way, the second antenna can be carried at or in proximity to a user body at a distance from the housing. This allows for flexibility with respect to the placement of the second antenna at or in proximity to the body of the user wearing the housing of the microphone device. For example, the second antenna can be placed in a pocket of a clothing of the user if the user is in a situation where the user feels more comfortable with less visible electronic devices.

A hearing aid system comprising a microphone device for wireless communication with a hearing aid to be worn at or in proximity to a first user, the microphone device configured to be worn at or in proximity to a second user, the microphone device includes: a housing; a microphone for conversion of an acoustic sound signal into an electrical signal; a transceiver for wireless radio frequency communication; a first antenna connectable to the transceiver; and a second antenna connectable to the transceiver; wherein the first antenna is accommodated within the housing; and wherein the second antenna is external to the housing such that the second antenna can be carried at or in proximity to the second user at a distance from the housing; and wherein the microphone device further comprises a distributor for distributing power to the first antenna, to the second antenna, or to both.

Optionally, the microphone device may comprise a fiber, and wherein the second antenna is connectable to the transceiver via the fiber.

Optionally, the fiber and the housing may be configured for interconnection.

Optionally, the second antenna may be attached to the fiber.

Optionally, the microphone device may comprise a least one connector for attachment of the microphone device at or in proximity to the second user.

Optionally, the fiber may be a neck fiber, and wherein the neck fiber and the housing may be configured for mutual interconnection for support of the housing at or in proximity to the second user.

Optionally, the fiber may be configured for accommodation of the second antenna in the far field of the first antenna.

Optionally, the fiber may be a wire, a cable, a string, or a lanyard.

A microphone device for wireless communication with a hearing aid to be worn at or in proximity to a first user, the microphone device configured to be worn at or in proximity to a second user, the microphone device includes: a housing; a microphone for conversion of an acoustic sound signal into an electrical signal; a transceiver for wireless radio frequency communication; a first antenna connectable to the transceiver; and a second antenna connectable to the transceiver; wherein the first antenna is accommodated within the housing; and wherein the second antenna is external to the housing such that the second antenna can be carried at or in proximity to the second user at a distance from the housing; and wherein the microphone device further comprises a distributor for distributing power to the first antenna, to the second antenna, or to both.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only exemplary embodiments and are not therefore to be considered limiting in the scope of the claims.

DETAILED DESCRIPTION

Figure 1:
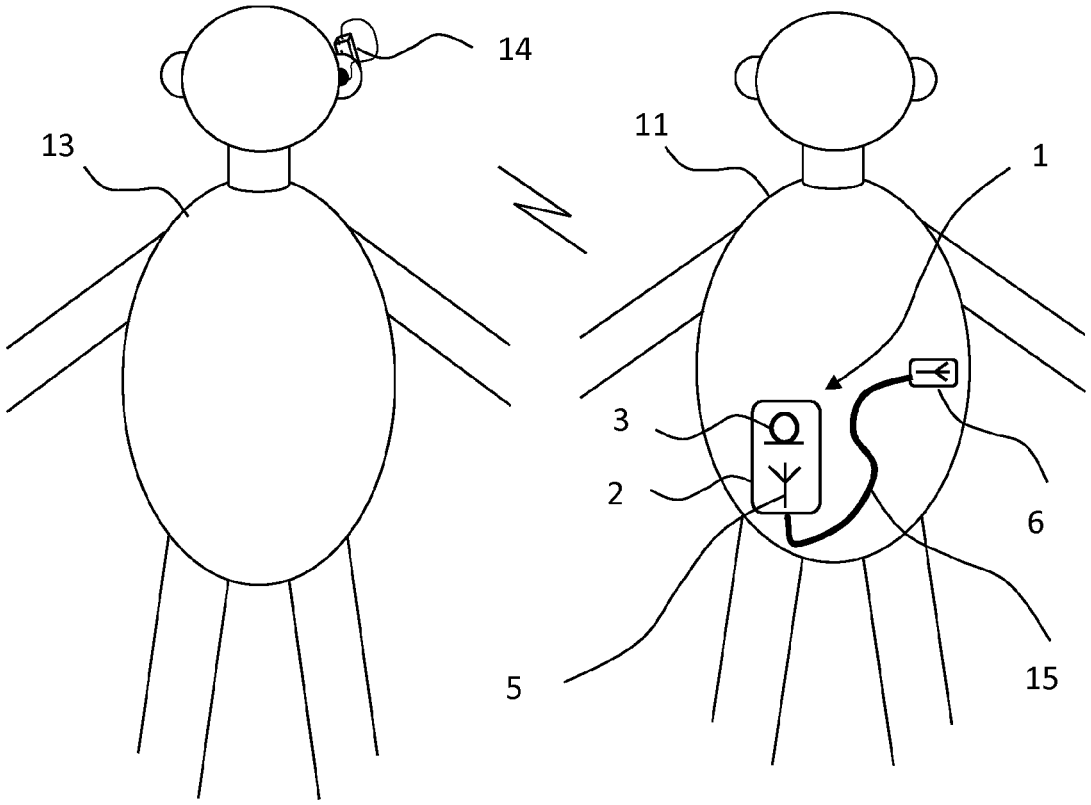
FIG. 1 shows a hearing aid system with a hearing aid at a first user and a microphone device at a second user.

Various embodiments are described hereinafter with reference to the figures. It should be noted that the figures are not necessarily drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The hearing aid system and microphone device will now be described more fully hereinafter with reference to the accompanying drawings, in which various examples are shown.

FIG. 1 shows a hearing aid system. The hearing aid system has a hearing aid 14 to be worn at or in proximity to a first user 13 and a microphone device 1 to be worn at or in proximity to a second user 11.

A part is at or in close proximity to a user when the part is attached or accommodated to a part of the body of the user or a piece of clothing or in a pocket or in another way close at hand such as lying at a table adjacent to the user.

For example, a hearing aid such as behind-the-ear (BTE) apparatus can be worn behind the ear of the user or a hearing aid such as an in-the-ear (ITE) apparatus can be worn in the ear of the user. A small hearing aid apparatus similar in size to the BTE type or the ITE type can be worn at the user in a pocket of a clothing with the receiver worn in the ear. Larger types of hearing aids are also known. Such a hearing aid can be placed at a table next to the user. Similarly, the microphone device can be placed on the upper body of the user or attached to a clothing or placed in a pocket. The microphone device can also be taped directly to the body of the user.

A part is interconnected with another part when the two parts are directly connected or fastened to each other, i.e. in abutting contact with each other; or when each of the two parts are both directly connected to the same third mechanical part; or when each of the two parts are both directly connected to a plurality of other interconnected mechanical parts, one of which is directly connected to one of the two parts and another of which is directly connected to the other of the two parts.

The first user is a hearing impaired and the second user can be a family member such as a child, a sister or a spouse etc.

The hearing aid and microphone device are configured for wireless communication. The microphone device can transmit and/or receive wireless signals to/from the hearing aid. The microphone device may be configured to operate only as a transmitter.

Figure 2:
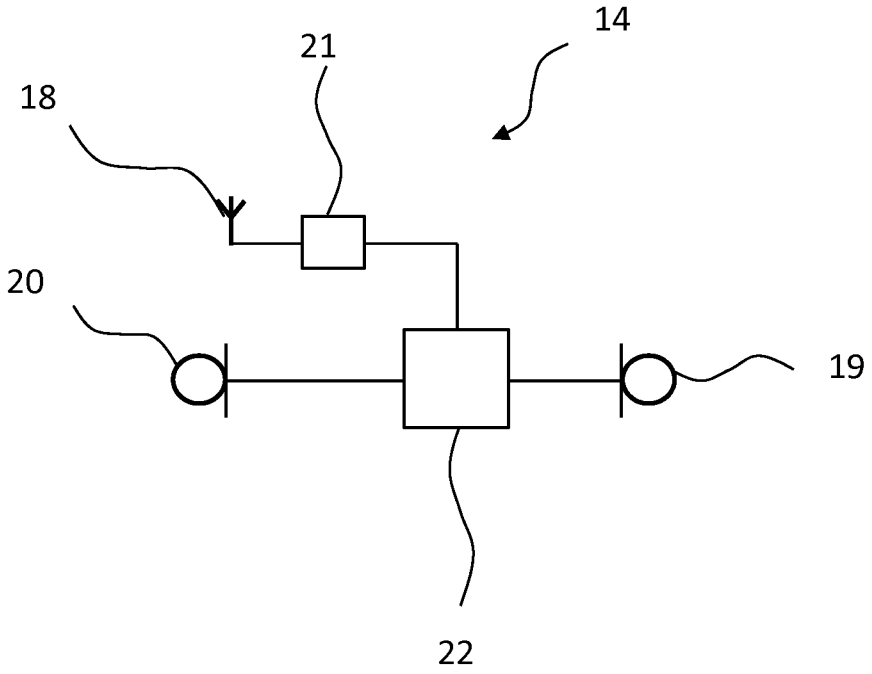
FIG. 2 shows a hearing aid.

FIG. 2 shows a hearing aid 14. The hearing aid comprises a microphone 20, an antenna 18 connectable to a transceiver 21, a processor 22 and a receiver 19. The microphone converts acoustic sound signals into electric signals which are provided to the processor. The transceiver is configured to receive a signal from the antenna and pass it to the processor. From the processor, a signal can be sent to the receiver which converts an electric signal into an acoustic signal.

Figure 3:
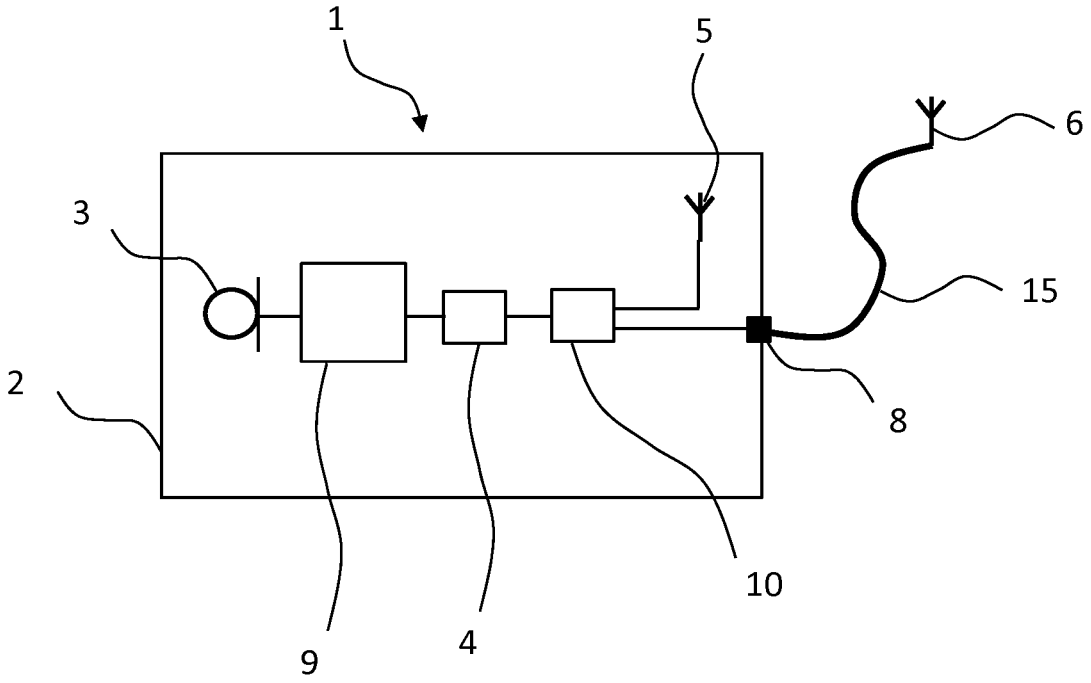
FIG. 3 shows a microphone device.

FIG. 3 shows a microphone device 1. The microphone device has a housing 2. The housing is for accommodation of internal parts such as electric circuits. A housing can accommodate a part when there is room for the part or the part can in other ways fit within the interior of the housing.

The microphone device has a microphone 3. The microphone converts acoustic sound signals into electric signals.

The microphone device comprises a transceiver 4 for wireless radio frequency communication, a first antenna 5 connectable to the transceiver and a second antenna 6 connectable to the transceiver. Wireless radio frequency communication is usually from a frequency in the MHz area up to frequencies in the GHz area. For example, a widely used frequency is at around 2.4 GHz. At this frequency many electronic devices communicate with each other. However, at such a frequency the wavelength when the electromagnetic field travels in free space is relative small compared to the dimensions of the human body. The human body can therefore be an obstacle for the electromagnetic field.

The transceiver 4 may be configured to send and/or receive radio communication via the first and second antennas. For example, the transceiver may transmit or send a first radio signal via the first antenna and a second radio signal via the second antenna. The first radio signal and the second radio signal may have the same frequency. The first radio signal has a first power and the second radio signal has a second power. The first power and the second power may be different for different operating modes of the microphone device. The first and the second radio signal may be representative of the acoustic sound signal received in the microphone.

A part is connectable to another part when the parts can be attached or coupled or in another way interconnected for establishing a communication between the parts and also be detached or decoupled or in another way disconnected from each other in order to break a communication between the parts.

The first antenna is accommodated within the housing, and the second antenna is external to the housing such that the second antenna can be carried at or in proximity to the first user at a distance from the housing. A part is external to the housing when it is not accommodated within the housing. A part is at a distance of another part when the distance between the parts is not zero or that the parts in another way are not in abutment with each other.

The microphone device comprises a fiber 15 wherein the fiber and the housing is configured for interconnection and wherein the second antenna is connectable to the transceiver via the fiber. When the fiber is interconnected with housing, a connector 16 of the fiber is coupled to a connector 8 of the housing.

The fiber is a wire, a cable, a string or a lanyard.

The second antenna is attached to the fiber at one end of the fiber. The second antenna can be attached at the fiber in the far field of the first antenna.

The microphone device has a least one connector for attachment of the microphone device at or in proximity to the second user.

The microphone device has a processor 9. The processor can process the electric signal from the microphone. In a digital embodiment, the microphone device comprises an analog to digital converter configured to convert the electric signal from an analog signal to a digital signal.

The microphone device has a distributor 10 for distributing transmission power to the first and/or second antenna. The transmission power may be distributed such that half of the transmission power from the transceiver is directed to the first antenna (first power) and half of the transmission power from the transceiver is directed to the second antenna (second power). Alternatively, more than half of the transmission power from the transceiver is directed to the first antenna and less than half of the transmission power from the transceiver is directed to the second antenna, i.e. the first power is larger than the second power. Alternatively, a controller (not shown) for the distributor may control the distributor such that 100% of the power is distributed to the first antenna, if the second antenna is detached. For example, if a user disconnects the fiber from its interconnection with the housing and the second antenna is attached to the fiber, the second antenna will be detached from the transceiver.

Figure 4:
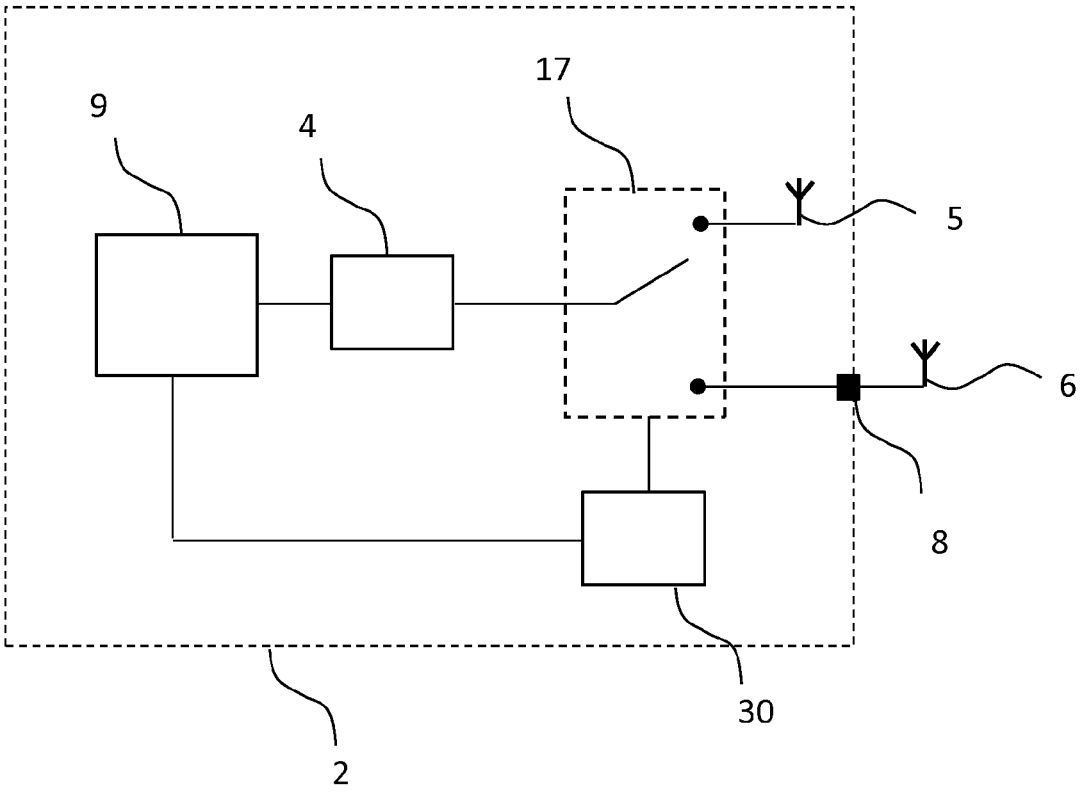
FIG. 4 shows part of a microphone device.

FIG. 4 shows part of a microphone device. The microphone device comprises a distributor in the form of a switch 17 for selectively connecting the first antenna or the second antenna to the transceiver. The switch may be operated by a switch controller 30 such that a controlled selection of the first antenna or the second antenna is provided. The switch can switch to the first antenna if the first antenna radiates at a higher signal-to-noise ratio than the second antenna or if the second antenna is detached. The switch can switch to the second antenna if the second antenna radiates at a higher signal-to-noise ratio than the first antenna. The switch controller or the processor may be configured to determine one or more parameters indicative of reception and/or transmission quality. The selection of mode of operation may be based on the one or more parameters, for example received signal strength indicator values for the first antenna (RSSI_1) and the second antenna (RSSI_2). A criterion may be used for determining the switching strategy between antennas. For example, a switch from a mode may be initiated if the signal-to-noise ratio or other value indicative of reception and/or transmission quality falls below or rises above a threshold value. Further, hysteresis can be used such that the signal to noise ratio or another function of the signal-to-noise ratio should compare to a threshold value before a switch between the first antenna and the second antenna is made.

Figure 5:
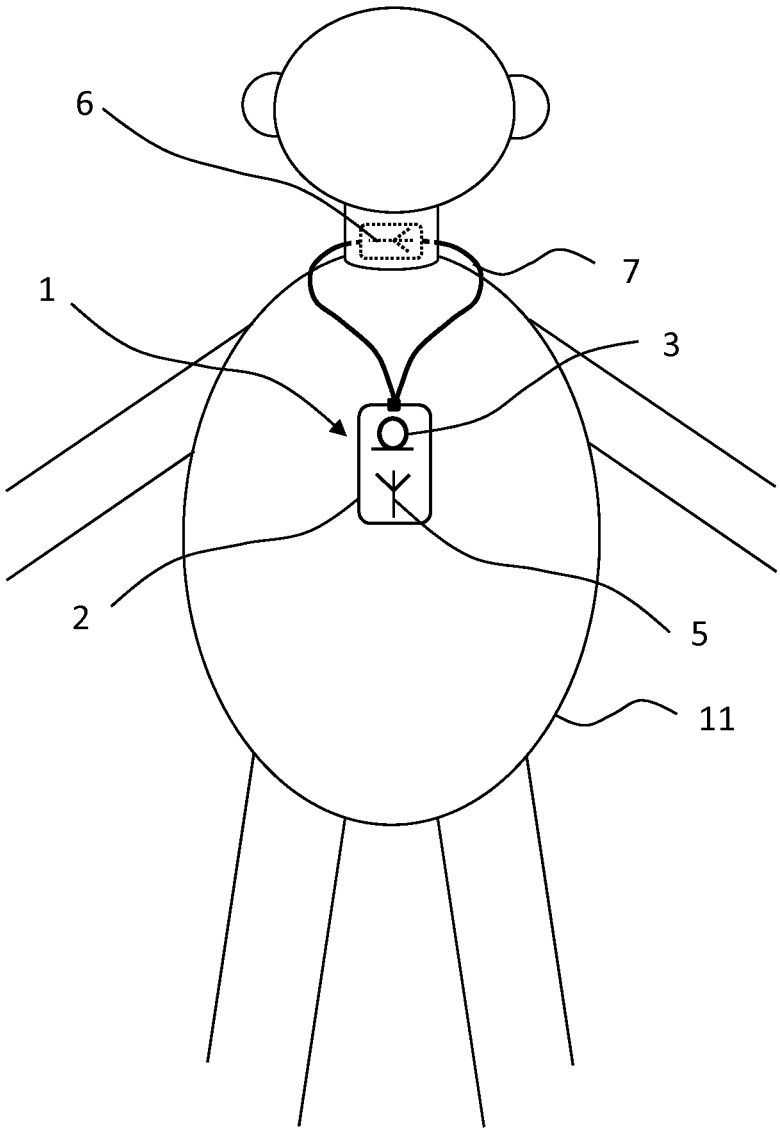
FIG. 5 shows a microphone device supported at a user by a neck fiber.

FIG. 5 shows a microphone device supported at a user by a neck fiber. The neck fiber and the housing are configured for mutual interconnection for support of the housing at or in proximity to the second user. The housing can hang from the neck fiber at or in proximity to the second user. The user can move around and engage in activities. The second antenna is accommodated at the neck fiber at a position such that the first antenna is accommodated within the housing at a first side of the second user and the second antenna is at a second side of the second user.

Figure 6:
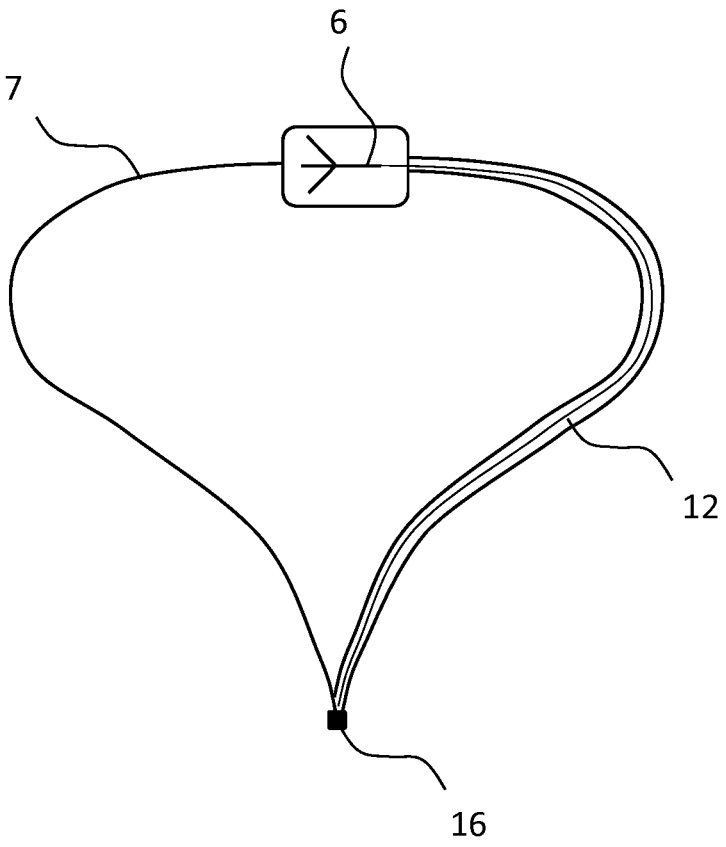
FIG. 6 shows a neck fiber.

FIG. 6 shows a neck fiber. Part of the neck fiber has a wire 12 and the second antenna is accommodated at the wire. The wire is for an electrical wire connection between the second antenna and the transceiver via the distributor or switch. Hereby, the second antenna may communicate with the transceiver when the neck fiber is interconnected with the housing.

Disclosed in the present document is a hearing aid system, microphone device and method according to any of the following items.

Item 1. A hearing aid system comprising a hearing aid to be worn at or in proximity to a first user and a microphone device to be worn at or in proximity to a second user wherein the hearing aid and microphone device are configured for wireless communication, the microphone device comprising a housing, a microphone for conversion of an acoustic sound signal into an electric signal, a transceiver for wireless radio frequency communication, a first antenna connectable to the transceiver, and a second antenna connectable to the transceiver, wherein the first antenna is accommodated within the housing, and wherein the second antenna is external to the housing such that the second antenna can be carried at or in proximity to the second user at a distance from the housing.

Item 2. A hearing aid system according to Item 1, wherein the microphone device comprises a fiber wherein the second antenna is connectable to the transceiver via the fiber.

Item 3. A hearing aid system according to Item 2, wherein the fiber and the housing are configured for interconnection.

Item 4. A hearing aid system according to any of Items 2-3, wherein the second antenna is attached to the fiber.

Item 5. A hearing aid system according to any of Items 1-4, wherein the microphone device comprises a least one connector for attachment of the microphone device at or in proximity to the second user.

Item 6. A hearing aid system according to any of Items 1-5, wherein the fiber is a neck fiber and wherein the neck fiber and the housing are configured for mutual interconnection for support of the housing at or in proximity to the second user.

Item 7. A hearing aid system according to any of Items 1-6, wherein the fiber is configured for accommodation of the second antenna in the far field of the first antenna.

Item 8. A hearing aid system according to any of Items 1-7, wherein the fiber is a wire, a cable, a string or a lanyard.

Item 9. A hearing aid system according to any of Items 1-8, wherein the microphone device comprises a distributor for distributing transmission power to the first and/or second antenna.

Item 10. A hearing aid system according to Item 9, wherein the microphone device is configured to operate in a first mode when the second antenna is not connected to the microphone device, and wherein the distributor in the first mode of operation distributes at least 90% of the transmission power to the first antenna.

Item 11. A hearing aid system according to any of Items 9-10, wherein the microphone device is configured to operate in a second mode when the second antenna is connected to the microphone device, and wherein the distributor in the second mode of operation distributes at least 30% of the transmission power to the second antenna.

Item 12. A microphone device to be worn at or in proximity to a second user and for wireless communication with a hearing aid to be worn at or in proximity to a first user, the microphone device comprising a housing, a microphone for conversion of an acoustic sound signal into an electric signal, a transceiver for wireless radio frequency communication, a first antenna connectable to the transceiver, a second antenna connectable to the transceiver, wherein the first antenna is accommodated within the housing, and wherein the second antenna is external to the housing such that the second antenna can be carried at or in proximity to the second user at a distance from the housing.

Item 13. A method for transmitting wireless communication to a hearing device from a microphone device configured to operate in different modes of operation, the microphone device comprising a housing, a microphone, a transceiver for wireless radio frequency communication, a first antenna connectable to the transceiver and accommodated in the housing, and a second antenna connectable to the transceiver and external to the housing, the method comprising converting an acoustic sound signal to the microphone into an electric signal;

transmitting a first radio signal representative of the acoustic sound signal via the first antenna in a first mode of operation; and transmitting a second radio signal representative of the acoustic sound signal via the second antenna in a second mode of operation.

Item 14. Method according to Item 13, the method comprising selecting the first mode of operation when the second antenna is not connected to the microphone device, and wherein transmitting a first radio signal in the first mode of operation comprises transmitting at least 90% of the transmission power to the first antenna.

Item 15. Method according to any of Items 13-14, the method comprising selecting the second mode of operation when the second antenna is connected to the microphone device, and wherein transmitting a second radio signal in the second mode of operation comprises transmitting at least 30% of the transmission power to the second antenna.

Although particular embodiments have been shown and described, it will be understood that they are not intended to limit the claimed inventions, and it will be obvious to those skilled in the art that various changes and modifications may be made without departing from the scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing aid system comprising a microphone device for wireless communication with a hearing aid to be worn at or in proximity to a first user, the microphone device configured to be worn at or in proximity to a second user, the microphone device comprising:

a housing;

a microphone for conversion of an acoustic sound signal into an electrical signal;

a transceiver for wireless radio frequency communication;

a first antenna connectable to the transceiver;

a second antenna connectable to the transceiver; and a fiber, wherein a major linear portion of the fiber is circumferentially exposed for touch by the second user;

wherein the first antenna is accommodated within the housing;

wherein the second antenna is external to the housing such that the second antenna can be carried at or in proximity to the second user; and wherein the microphone device further comprises a distributor for distributing power to the first antenna and to the second antenna; and wherein the second antenna is coupled to the fiber, and wherein the second antenna has at least a portion that is serially disposed with respect to the fiber.

2. The hearing aid system according to claim 1, wherein the second antenna is connectable to the transceiver via the fiber.

3. The hearing aid system according to claim 1, wherein the fiber and the housing are configured for interconnection.

4. The hearing aid system according to claim 1, wherein the second antenna has another portion that is inside the fiber.

5. The hearing aid system according to any of claims 1-4, wherein the microphone device comprises at least one connector for attachment of the microphone device at or in proximity to the second user.

6. The hearing aid system according to claim 1, wherein the fiber is a neck fiber, and wherein the neck fiber and the housing are configured for mutual interconnection for support of the housing at or in proximity to the second user.

7. The hearing aid system according to any of claims 1-4 and 6, wherein the fiber is configured for accommodation of at least a linear segment of the second antenna.

8. The hearing aid system according to any of claims 1-4 and 6, wherein the fiber is a wire, a cable, a string, or a lanyard.

9. A microphone device for wireless communication with a hearing aid to be worn at or in proximity to a first user, the microphone device configured to be worn at or in proximity to a second user, the microphone device comprising:

a housing;

a microphone for conversion of an acoustic sound signal into an electrical signal;

a transceiver for wireless radio frequency communication;

a first antenna connectable to the transceiver;

a second antenna connectable to the transceiver; and a fiber, wherein a major linear portion of the fiber is circumferentially exposed for touch by the second user;

wherein the first antenna is accommodated within the housing; and wherein the second antenna is external to the housing such that the second antenna can be carried at or in proximity to the second user; and wherein the second antenna is coupled to the fiber, and wherein the second antenna has at least a portion that is serially disposed with respect to the fiber.

10. The hearing aid system according to claim 1, wherein the distributor is configured to distribute power to both the first and second antennas so that the first antenna receives and the second antenna receive a same amount of power.

11. A microphone device for wireless communication with a hearing aid, the microphone device comprising:

a housing;

a microphone for conversion of an acoustic sound signal into an electrical signal;

a transceiver for wireless radio frequency communication;

a first antenna coupled to the transceiver;

a second antenna coupled to the transceiver; and a fiber, wherein a major linear portion of the fiber is circumferentially exposed for touch by a user;

wherein the first antenna is accommodated within the housing; and wherein the second antenna is external to the housing; and wherein the second antenna is coupled to the fiber, and wherein the second antenna has at least a portion that is serially disposed with respect to the fiber.

12. The microphone device according to claim 11, wherein the second antenna is connectable to the transceiver via the fiber.

13. The microphone device according to claim 11, wherein the fiber and the housing are configured for interconnection.

14. The microphone device according to claim 11, wherein the second antenna has another portion that is inside the fiber.

15. The microphone device according to claim 11, wherein the fiber is a neck fiber.

16. The microphone device according to claim 11, wherein the fiber is configured for accommodation of at least a linear segment of the second antenna.

17. The microphone device according to claim 11, wherein the fiber is a wire, a cable, a string, or a lanyard.

18. The microphone device according to claim 12, wherein the first and second antennas are configured to receive a same amount of power.

19. The microphone device according to claim 12, wherein the first and second antennas are configured to receive different amounts of power.

20. The hearing aid system of claim 1, wherein the first antenna has a first polarization, the second antenna has a second polarization, and an orientation of the first polarization and an orientation of the second polarization are different.

21. The microphone device of claim 9, wherein the first antenna has a first polarization, the second antenna has a second polarization, and an orientation of the first polarization and an orientation of the second polarization are different.

22. The microphone device of claim 11, wherein the first antenna has a first polarization, the second antenna has a second polarization, and an orientation of the first polarization and an orientation of the second polarization are different.

23. The hearing aid system of claim 1, wherein the second antenna is coupled serially to the fiber.

24. The hearing aid system of claim 1, wherein the second antenna is located in a far field of the first antenna.

25. The hearing aid system of claim 1, wherein the fiber comprises a first connector configured to connect the fiber to a second connector at the microphone device.

26. The microphone device of claim 9, wherein the second antenna is coupled serially to the fiber.

27. The microphone device of claim 9, wherein the second antenna is located in a far field of the first antenna.

28. The microphone device of claim 9, wherein the fiber comprises a first connector configured to connect the fiber to a second connector at the microphone device.

29. The microphone device of claim 11, wherein the second antenna is coupled serially to the fiber.

30. The microphone device of claim 11, wherein the second antenna is located in a far field of the first antenna.

31. The microphone device of claim 11, wherein the fiber comprises a first connector configured to connect the fiber to a second connector at the microphone device.

32. A microphone device for wireless communication with a hearing aid, the microphone device comprising:

a housing;

a microphone for conversion of an acoustic sound signal into an electrical signal;

a transceiver for wireless radio frequency communication;

a first antenna coupled to the transceiver;

a second antenna coupled to the transceiver; and a fiber, wherein a major linear portion of the fiber is circumferentially exposed for touch by a user;

wherein the first antenna is accommodated within the housing; and wherein the second antenna is external to the housing; and wherein the second antenna is coupled to the fiber, and wherein the fiber comprises a first connector configured to connect the fiber to a second connector at the microphone device, wherein at least a portion of the second antenna is located beyond a longitudinal extent of the fiber.

* * * * *